US009643443B2

(12) United States Patent
Bogdanski et al.

(10) Patent No.: US 9,643,443 B2
(45) Date of Patent: May 9, 2017

(54) GREETING CARDS WITH SUSPENDED MOTION

(71) Applicant: American Greetings Corporation, Cleveland, OH (US)

(72) Inventors: Sharon Bogdanski, Solana Beach, CA (US); John Talbot, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/922,236

(22) Filed: Oct. 26, 2015

(65) Prior Publication Data

US 2016/0114613 A1 Apr. 28, 2016

Related U.S. Application Data

(60) Provisional application No. 62/069,364, filed on Oct. 28, 2014.

(51) Int. Cl.

| | |
|---|---|
| ***B65D 85/57*** | (2006.01) |
| ***G09F 1/06*** | (2006.01) |
| ***B42D 15/04*** | (2006.01) |
| ***B42D 15/02*** | (2006.01) |

(52) U.S. Cl.
CPC ..... *B42D 15/042* (2013.01); *B42D 15/022* (2013.01); *B42D 15/045* (2013.01)

(58) Field of Classification Search
CPC ..... B42D 15/022; B42D 15/042; G09F 19/02; G09F 1/04
USPC ..... 40/124.03
See application file for complete search history.

(56) References Cited

U.S. PATENT DOCUMENTS

| | | | | |
|---|---|---|---|---|
| 930,108 | A * | 8/1909 | Walcutt | B42D 15/042 119/430 |
| 2,152,299 | A * | 3/1939 | Arndt | G09F 23/00 206/102 |
| 2,511,211 | A * | 6/1950 | Klein | B65D 5/4258 206/45.28 |
| 2,742,723 | A * | 4/1956 | Goldie Klein | B42D 15/04 40/124.09 |
| 2,884,738 | A * | 5/1959 | Lohnes | B42D 15/04 40/124.08 |
| 4,319,418 | A * | 3/1982 | Transport | B44C 3/12 40/124.14 |
| 4,531,319 | A | 7/1985 | Saxton | |
| 4,729,182 | A | 3/1988 | Sherman | |
| 5,317,823 | A * | 6/1994 | Brunt, II | G09F 1/08 206/308.1 |

(Continued)

FOREIGN PATENT DOCUMENTS

WO WO2012046104 4/2012

*Primary Examiner* — Shin Kim
(74) *Attorney, Agent, or Firm* — Christine Flanagan

(57) ABSTRACT

The present invention is directed to various embodiments of a greeting card having at least one motor attached to a mechanism which causes movement to a mobile object and one or more attachments suspended from the mobile object. The mobile object may be a circular disc, a string or a swing structure. Each mobile object contains one or more attachments either attached directly thereto or suspended therefrom via a string or line. The motor may effect various movements in the mobile object such as circular motion, back-and-forth motion or bouncing or vibrating motion.

16 Claims, 16 Drawing Sheets

(56) References Cited

U.S. PATENT DOCUMENTS 5,588,233 A * 12/1996 Volkert ..... B31D 5/04 40/124.08
5,613,612 A * 3/1997 Davault ..... G11B 23/40 206/308.1
5,658,620 A * 8/1997 Ross ..... G09F 1/08 40/539
5,682,999 A * 11/1997 Larson ..... A63H 3/18 206/45.28
5,738,221 A * 4/1998 Van Witt ..... G11B 33/0405 206/308.1
5,864,973 A * 2/1999 Cole ..... B42D 15/042 273/157 R
5,933,989 A * 8/1999 Volkert ..... G09F 1/06 40/124.08
5,937,553 A * 8/1999 Maran ..... G09F 1/06 40/124.08
6,199,912 B1 * 3/2001 Finkelshteyn ..... B42D 15/045 283/117
6,311,142 B1 * 10/2001 Glassner ..... G06T 19/00 446/388
6,460,277 B1 * 10/2002 Tower ..... A44C 3/001 40/1.5
6,966,135 B1 * 11/2005 McDonald ..... G11B 33/0422 206/232
7,395,622 B2 * 7/2008 Malkovas ..... G09F 1/04 40/124.08
7,618,301 B2 * 11/2009 Knight ..... A63H 33/42 446/478
7,722,431 B2 5/2010 Sullivan et al.
7,753,753 B2 * 7/2010 Payne ..... A63H 33/42 446/478
8,020,325 B2 * 9/2011 Ross ..... A63H 33/38 270/41
8,256,150 B2 9/2012 Qiao et al.
8,490,306 B2 * 7/2013 Guo ..... B42D 15/022 40/124.03
8,499,478 B1 * 8/2013 Glass ..... B42D 15/045 40/124.08
8,615,910 B2 * 12/2013 Glass ..... G09F 1/04 206/449
9,469,146 B2 * 10/2016 Bogdanski ..... B42D 15/042
9,475,333 B2 * 10/2016 Yeh ..... G09F 1/08
9,534,658 B1 * 1/2017 Rivas ..... F16F 15/302
2006/0117626 A1 6/2006 Cheng
2007/0289184 A1 12/2007 Cheng
2008/0032587 A1 2/2008 Krivanek et al.
2009/0126239 A1 5/2009 Clegg
2010/0056021 A1 * 3/2010 Carlson ..... G09F 19/08 446/487
2012/0266504 A1 * 10/2012 Michlin ..... B42D 15/042 40/124.08
2013/0139419 A1 * 6/2013 Guo ..... B42D 15/022 40/124.03
2013/0269225 A1 * 10/2013 Nelson ..... B42D 15/022 40/124.03
2016/0114613 A1 * 4/2016 Bogdanski ..... B42D 15/042 40/124.03

* cited by examiner

GREETING CARDS WITH SUSPENDED MOTION

RELATED APPLICATIONS

This application claims priority to U.S. Provisional Patent Application No. 62/069,364, filed on Oct. 28, 2014, a copy of which is incorporated by reference in its entirety.

FIELD OF THE INVENTION

The present invention is in the field of greeting cards and social expression products. More specifically, the invention is directed to a greeting card with sound and motorized movement.

SUMMARY OF THE INVENTION

In one embodiment, the greeting card of the present invention contains a motor and a mobile structure which can be folded and unfolded like a pop-up structure with the opening and closing of the greeting card. The mobile structure contains suspended die cut shapes which move in a circular motion upon opening the greeting card.

In another embodiment, the greeting card contains a swing structure which is extended from a rod and which is able to move or swing in a back-and-forth motion.

In still another embodiment, the greeting card contains a string which is attached to opposing sides of a two panel greeting card, the string being attached at one end to a motor concealed within the greeting card body. When the greeting card is opened, the motor is initiated, causing the string and die cut items suspended therefrom to move in a bouncing motion.

DETAILED DESCRIPTION OF PREFERRED AND ALTERNATE EMBODIMENTS

In a first embodiment, the greeting card of the present invention combines a traditional greeting card with a motorized mobile and audio playback. The motorized mobile contains one or more objects which are suspended from a disc which rotates upon activation of a motor module contained within the greeting card.

In a preferred embodiment, the greeting card body contains four greeting card panels 10A, 10B, 10C, 10D. Each greeting card panel 10A, 10B, 10C, 10D is substantially planar and contains a front surface and a back surface opposite the front surface. A first panel 10A is attached to a second panel 10B along a first fold line F1, the second panel 10B is attached to a third panel 10C along a second fold line F2, and the third panel 10C is attached to a fourth panel 10D along a third fold line F3. The first panel 10A is folded over the second panel 10B along the first fold line F1 and attached thereto creating a first closed pocket or cavity therebetween. Similarly, the fourth panel 10D is folded over the third panel 10C along the third fold line F3 and attached thereto creating a second closed pocket or cavity therebetween. The electronic components of the greeting card 100 are contained within the second pocket. However, the electronic components may be placed in the first pocket or in both the first and second pockets. The first panel 10A serves as the inside left panel of the greeting card 100, the second panel 10B serves as the front cover of the greeting card 100, the third panel 10C serves as the back or rear cover of the greeting card 100 and the fourth panel 10D serves as the inside right panel of the greeting card 100. The second fold line F2 serves as the bisecting line about which the greeting card 100 opens and closes. The first 10A and fourth 10D greeting card panels contain a slit or narrow opening S1, S2 thereon to accommodate insertion of and attachment to a portion of the mobile structure M. The slit S1 contained on the first panel 10A (inside left panel) is a partial slit which is contained on an upper right hand area of the panel 10A. The slit S2 contained on the fourth panel 10D (inside right panel) is a horizontal slit which extends across the horizontal width of the fourth panel 10D. Each of the greeting card panels 10A, 10B, 10C, 10D may contain photos, artwork, text sentiment, or other printed indicia thereon.

Figure 1:
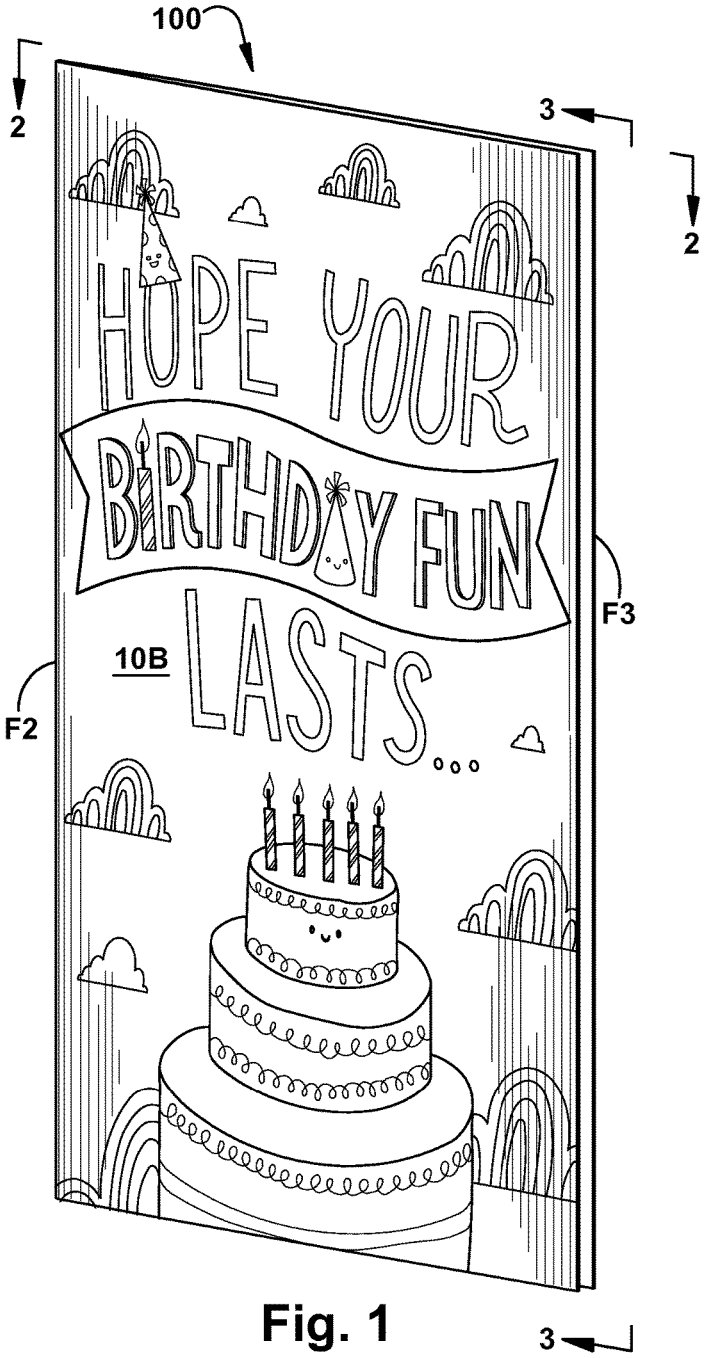
FIG. 1 is a perspective view of a first embodiment of the Greeting Card of the present invention, in a closed position.
Figure 2:
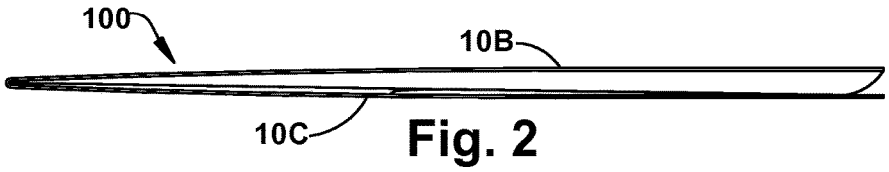
FIG. 2 is a top down view of the Greeting Card of FIG. 1, from the perspective of arrows 2-2.
Figure 3:
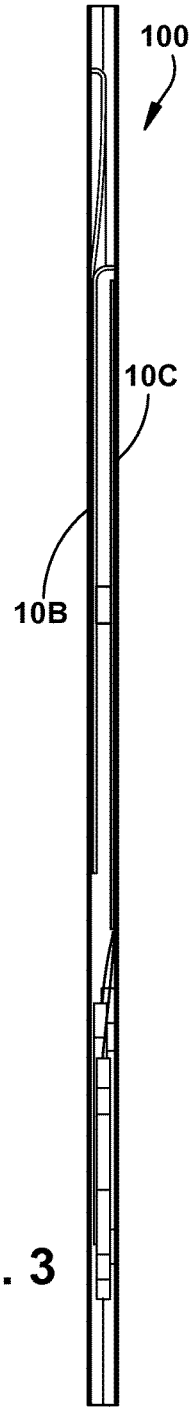
FIG. 3 is a right side view of the Greeting Card of FIG. 1, from the perspective of arrows 3-3.
Figure 4:
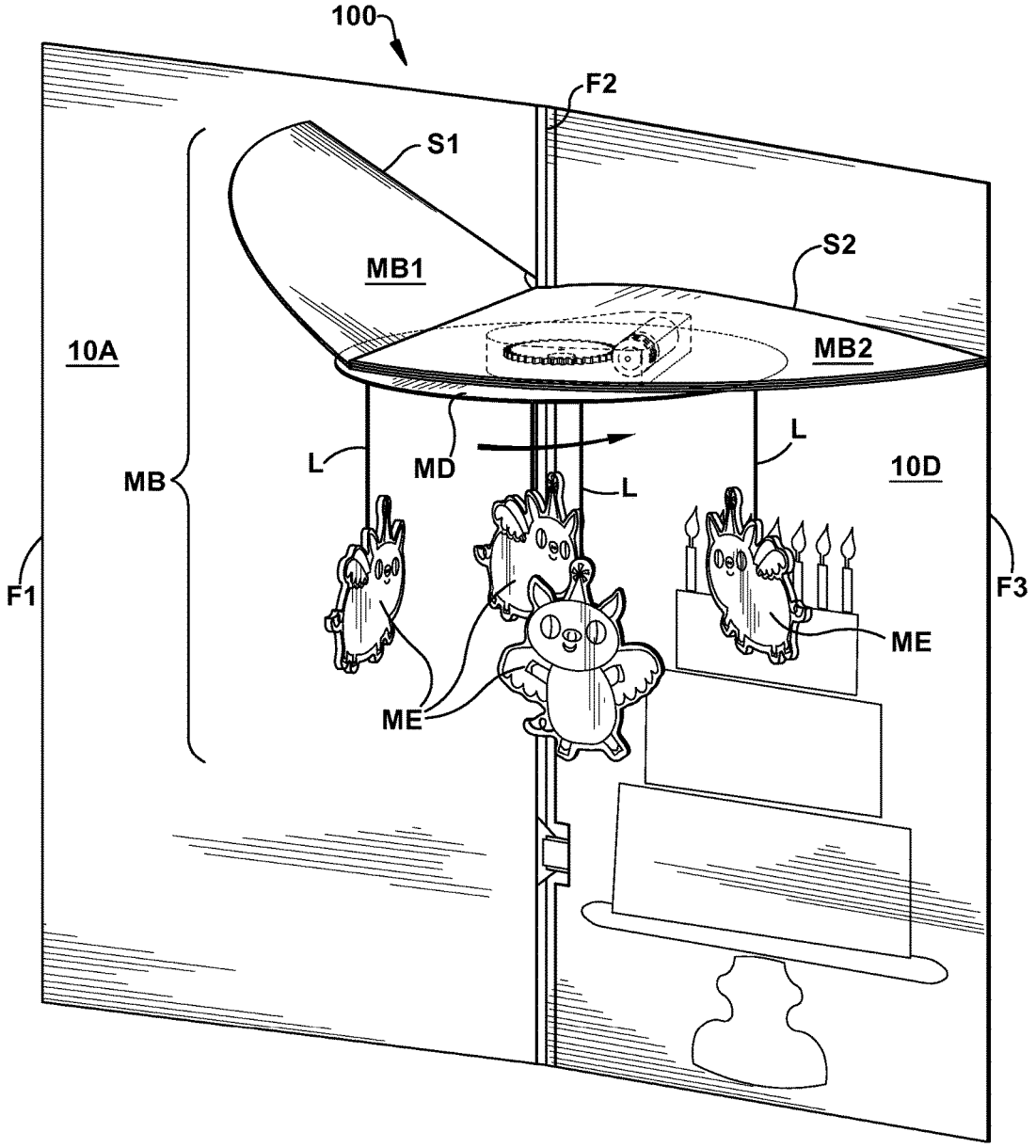
FIG. 4 is a perspective view of the Greeting Card of FIG. 1, in an open position.
Figure 5:
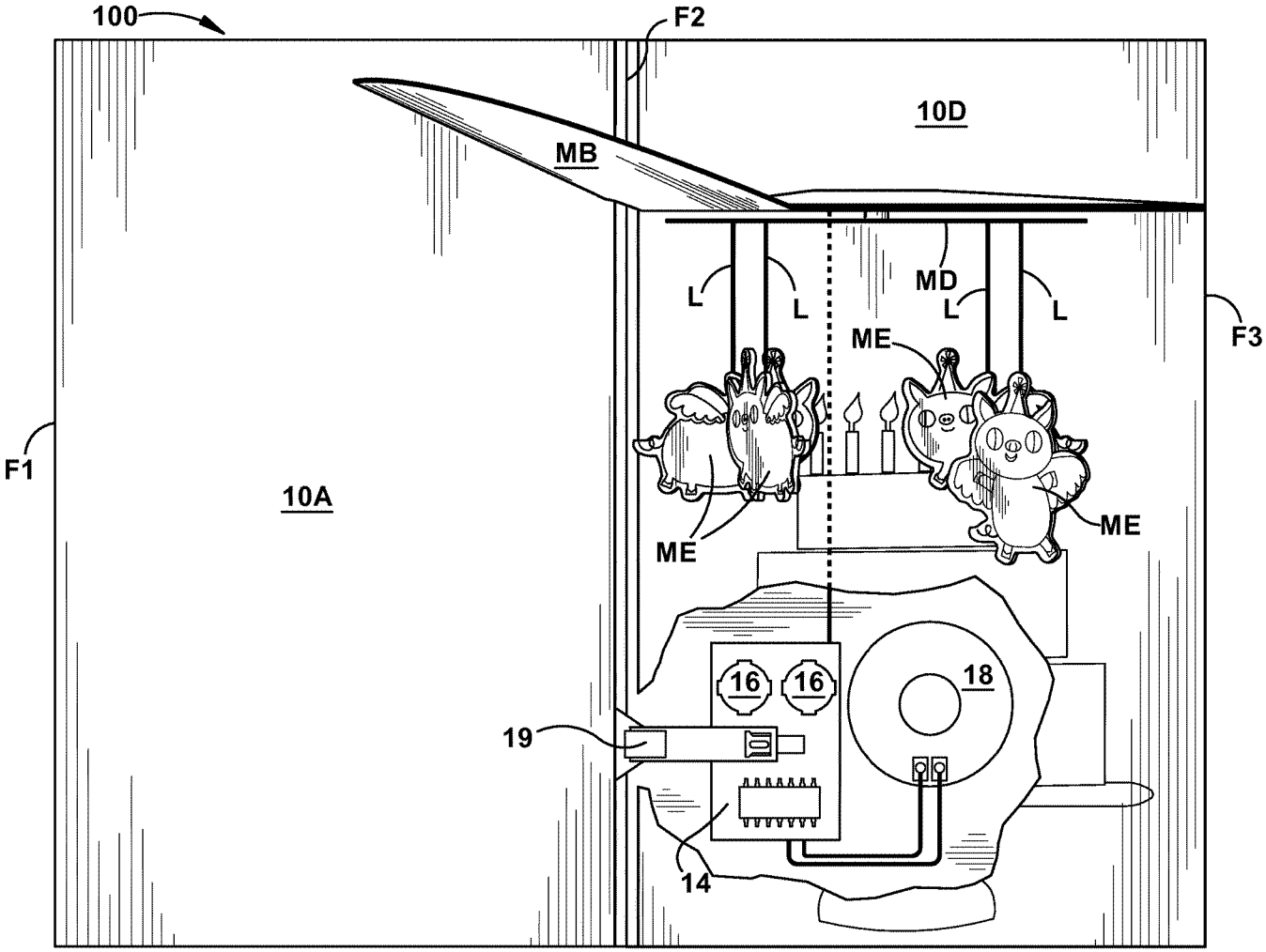
FIG. 5 is a front view of the Greeting Card of FIG. 4.
Figure 6:
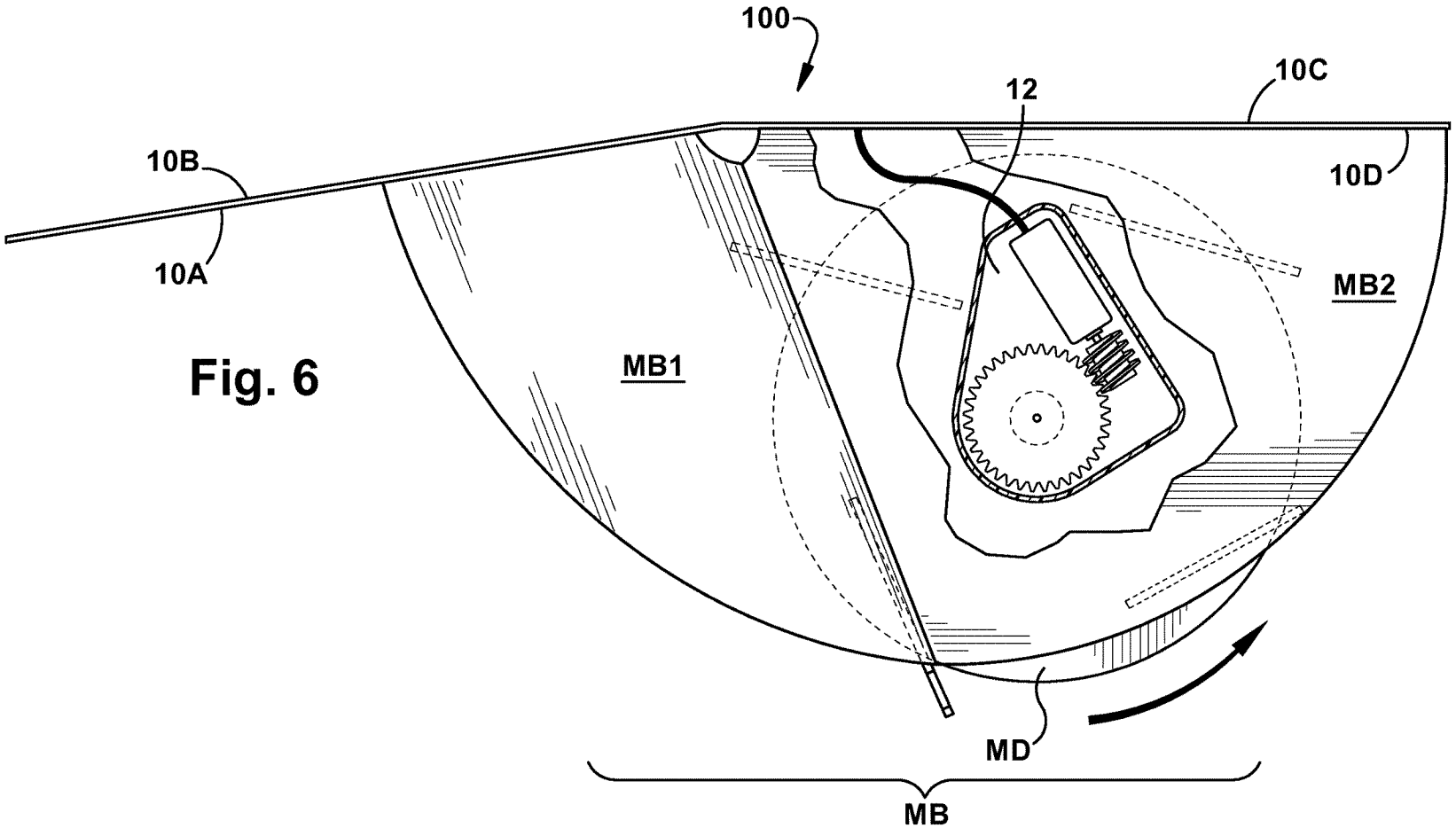
FIG. 6 is a top down view of the Greeting Card of FIG. 4.
Figure 7:
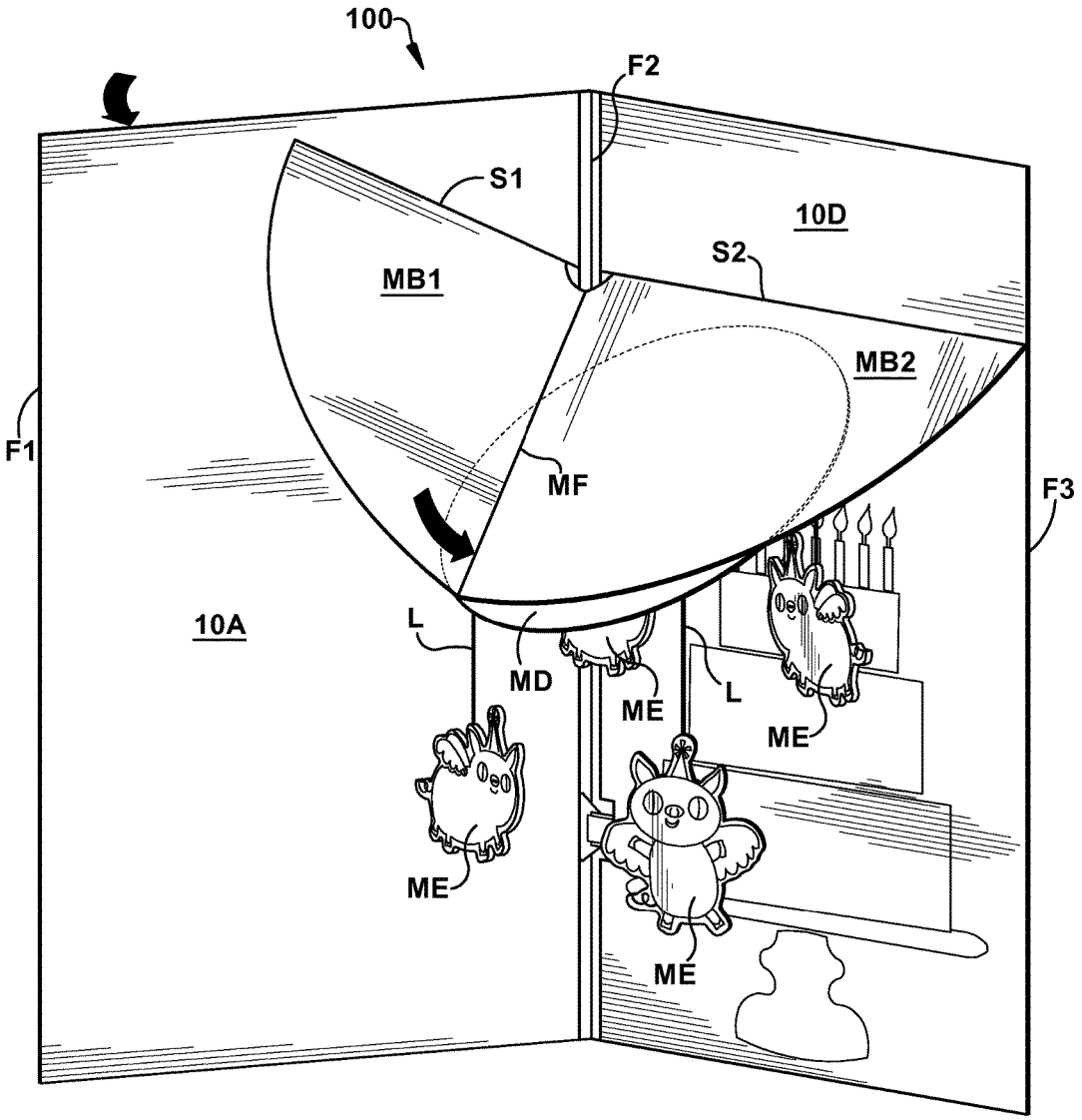
FIG. 7 is a perspective view of the Greeting Card of FIG. 4, in a partially open position.

The mobile structure M contains a half-circular base structure MB and a rotating disc MD which is attached below the base structure MB and which contains various shapes or elements ME which are suspended therefrom. The half-circular base structure MB contains a main fold line thereon MF which separates the base structure MB into two integral unequal sides MB1, MB2. The first or smaller side MB1 is attached to the first greeting card panel 10A (inside left panel) by inserting a portion thereof into the slit S1 contained on the first panel 10A and being adhered thereto via glue or other attachment mechanism. The second or larger side of the base structure MB2 is attached to the fourth greeting card panel 10D (inside right panel) by inserting a portion thereof into the slit S2 contained on the fourth panel 10D and being adhered thereto via glue or other attachment mechanism. The second side of the base structure MB2 contains two overlapping panels which are attached along all perimeter edges forming a closed pocket or cavity therein. A motor module 12 is contained within this pocket which enables movement of the circular disc MD and suspended shapes or elements ME, as shown in FIG. 6. The entire base structure MB is moveable between a first position and a second position. In the first position, the base structure MB is folded flat between the first 10A and fourth 10D panels on the inside of the greeting card 100, as shown in FIGS. 1 through 3. The first or smaller side of the base structure MB1 gets folded along the fold line MF to lie atop the second or larger side of the base structure MB2 which folds downward to lie flush with the fourth greeting card panel 10D (inside right panel). In the second position the base structure MB is unfolded wherein it is perpendicular to the inside panels of the greeting card (first 10A and fourth 10D panels), as shown in FIGS. 4 through 7. The base structure MB is in the first position when the greeting card 100 is in a closed position with the front cover 10B folded about the bisecting fold line F2 to lie atop the right inside panel 10D of the greeting card 100. It is moved from the first position to the second position by opening the greeting card 100 by moving the front cover 10B away from the inside right panel 10D about the bisecting fold line F2. The circular disc MD is attached directly to the motor 12 via an attachment arm through an opening in the underside of the second side of the base structure MB2. The circular disc MD is located directly beneath the second or larger side of the base structure MB2. The circular disc MD contains one or more die cut shapes ME which are suspended from the disc MD via a thin string or line L, such that they are freely suspended therefrom. The string or line L may be a fiber optic strand, fishing line, or other such material. In a preferred embodiment, the circular disc MD contains four die cut shapes ME suspended therefrom about the outer edges of the disc MD. When the motor module 12 is activated, the motor 12 turns the circular disc MD and attached die cut shapes ME in a circular motion, similar to a mobile which hangs from a baby's crib. The die cut shapes ME may be made of foam, paper or other lightweight material. They may be shaped like different characters, animals or objects such as cupcakes or candy, or any other conceivable shape. The shapes may be of the same or different sizes and may be made of the same or different material. There may be fewer or greater than four shapes attached to the circular disc MD.

In addition to the motor module 12 which allows for movement of the mobile, the greeting card 100 may also contain a sound module for replaying audio. The sound module may contain any and all components necessary to store and produce or emit sound. The motor module 12 may contain any and all components necessary to create movement of the mobile object (MD, ME). Some of the internal electronic components may include, but are not limited to: a circuit board 14; an integrated circuit chip; a power source 16; a speaker 18; a motor 12, a switch 19 and at least one pre-recorded digital audio clip. The electronic components of the greeting cards described herein are considered to be readily understood and appreciated by one of ordinary skill in the art and are therefore not discussed in detail herein.

In operation, a user would open the greeting card 100 by pivoting the front panel 10B outward about the bisecting fold line F2. The mobile structure M would move from the first, folded position to the second, unfolded position. A slide switch 19 may be contained across the bisecting fold line F2 of the greeting card 100 which causes the circular disc portion MD (and attached shapes ME) of the mobile M to move in a circular motion and also cause the playback of audio upon opening the greeting card 100. The audio and motion may continue for a predetermined period of time or they may continue until the user closes the greeting card 100.

As an alternative, the greeting card may be non-motorized so that the mobile structure M could be moveable by manual user interaction only. The greeting card may also be made without the sound module.

While the first embodiment has been described herein as having a slide switch located across a fold line, other types of switches may be used, such as a push button switch, a slide lever switch, a contact switch, a magnetic switch, a light-sensitive switch, a touch-sensitive switch, or any other conceivable switch mechanism. The greeting card has also been described herein and shown in the figures to have four shapes ME attached to the mobile M, however, other numbers of shapes have been contemplated such as one, two, three, five and greater than five. The shapes can be made of any type of material and can take on a variety of different physical shapes. The mobile M may also be located in areas of the greeting card different from the position shown in the figures. The greeting card may contain more or fewer panels and may take on a different configuration. One or more audio files may be contained on the sound module and a different audio clip may be replayed each time the greeting card is opened (up to the number of audio clips contained on the sound module) in random or in a particular order.

In a second embodiment of the present invention, shown in FIGS. 8 through 11, a z-fold greeting card structure is combined with a swing structure which can "swing" in a back-and-forth motion. In a preferred embodiment, the greeting card contains a small motor and the back-and-forth swinging motion is motorized. However, in an alternate embodiment, the back-and-forth swinging motion is effected by manual user interaction.

Figure 8:
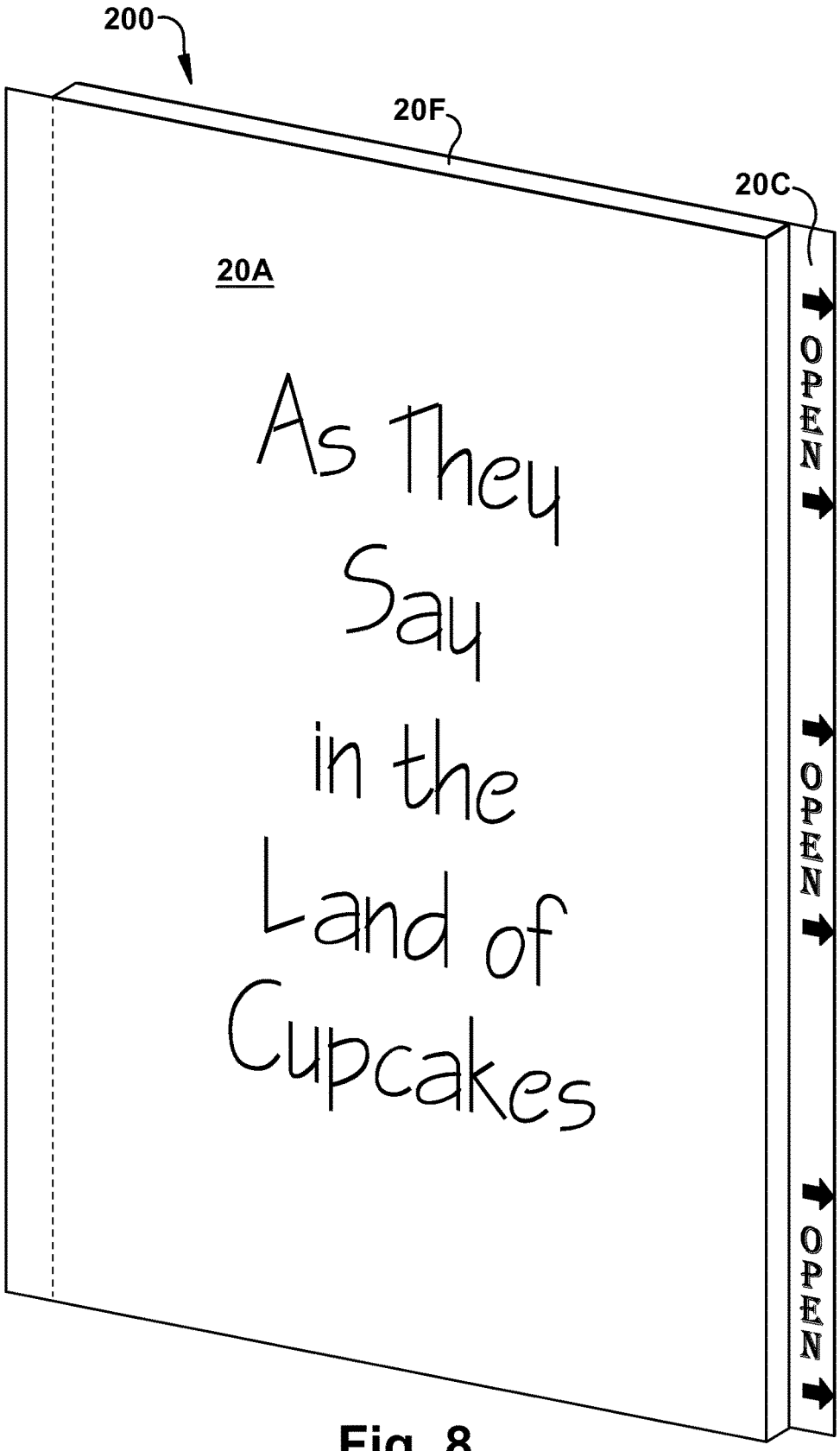
FIG. 8 is a perspective view of a second embodiment of the Greeting Card of the present invention, in a closed position.
Figure 9:
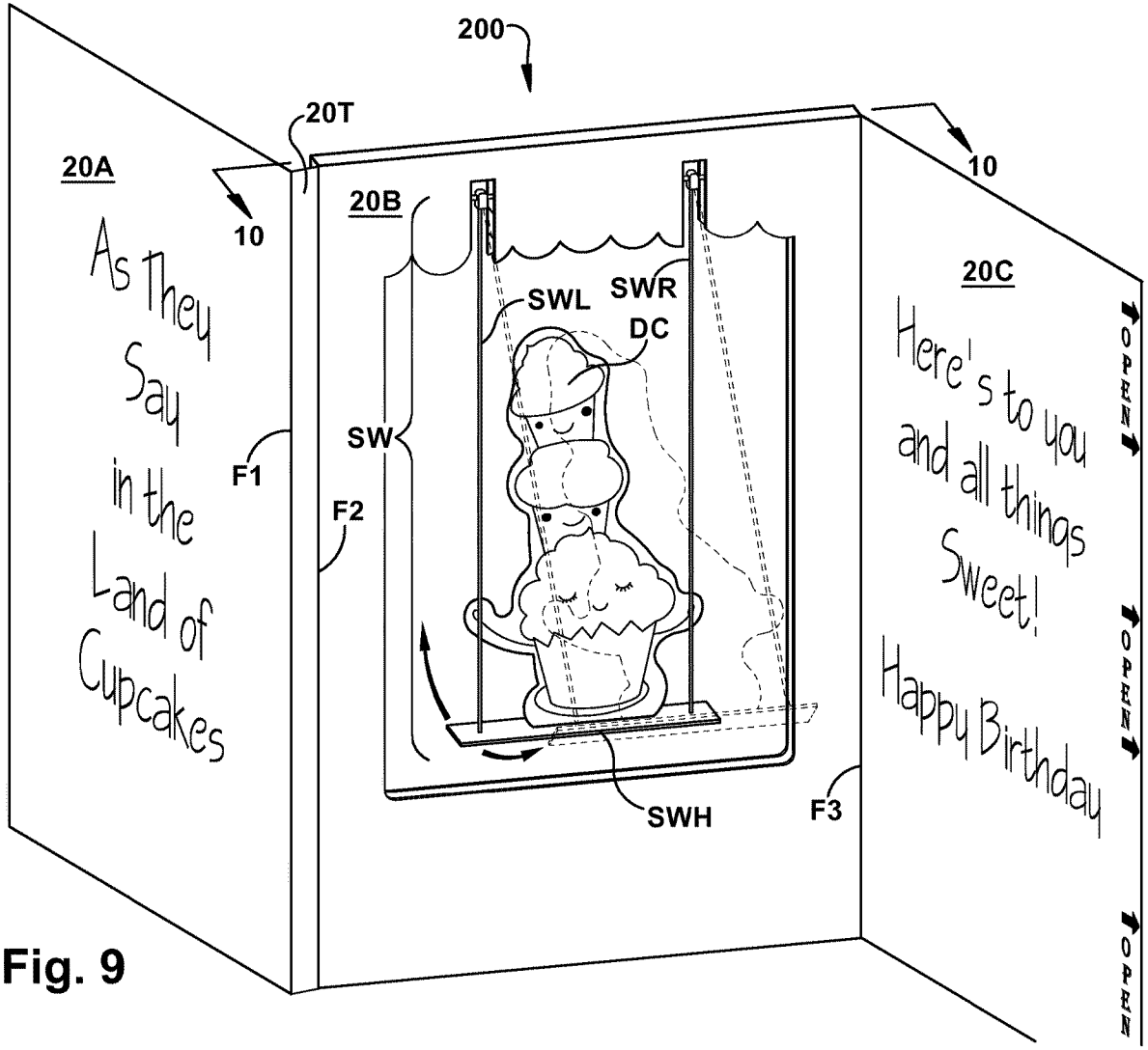
FIG. 9 is a perspective view of the Greeting Card of FIG. 8, in an open position.
Figure 10:
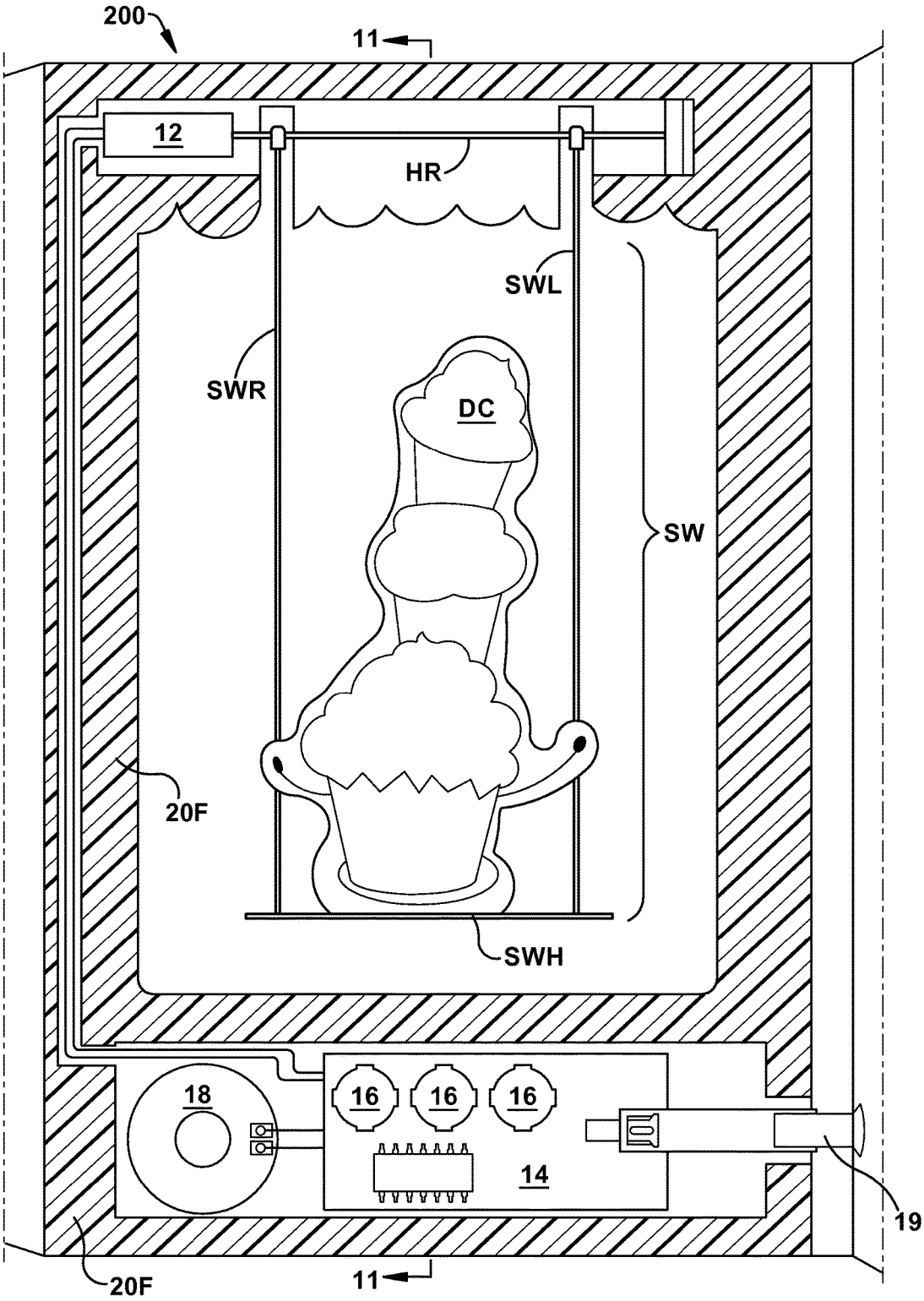
FIG. 10 is a cut-away front view of a center panel of the Greeting Card of FIG. 8.
Figure 11:
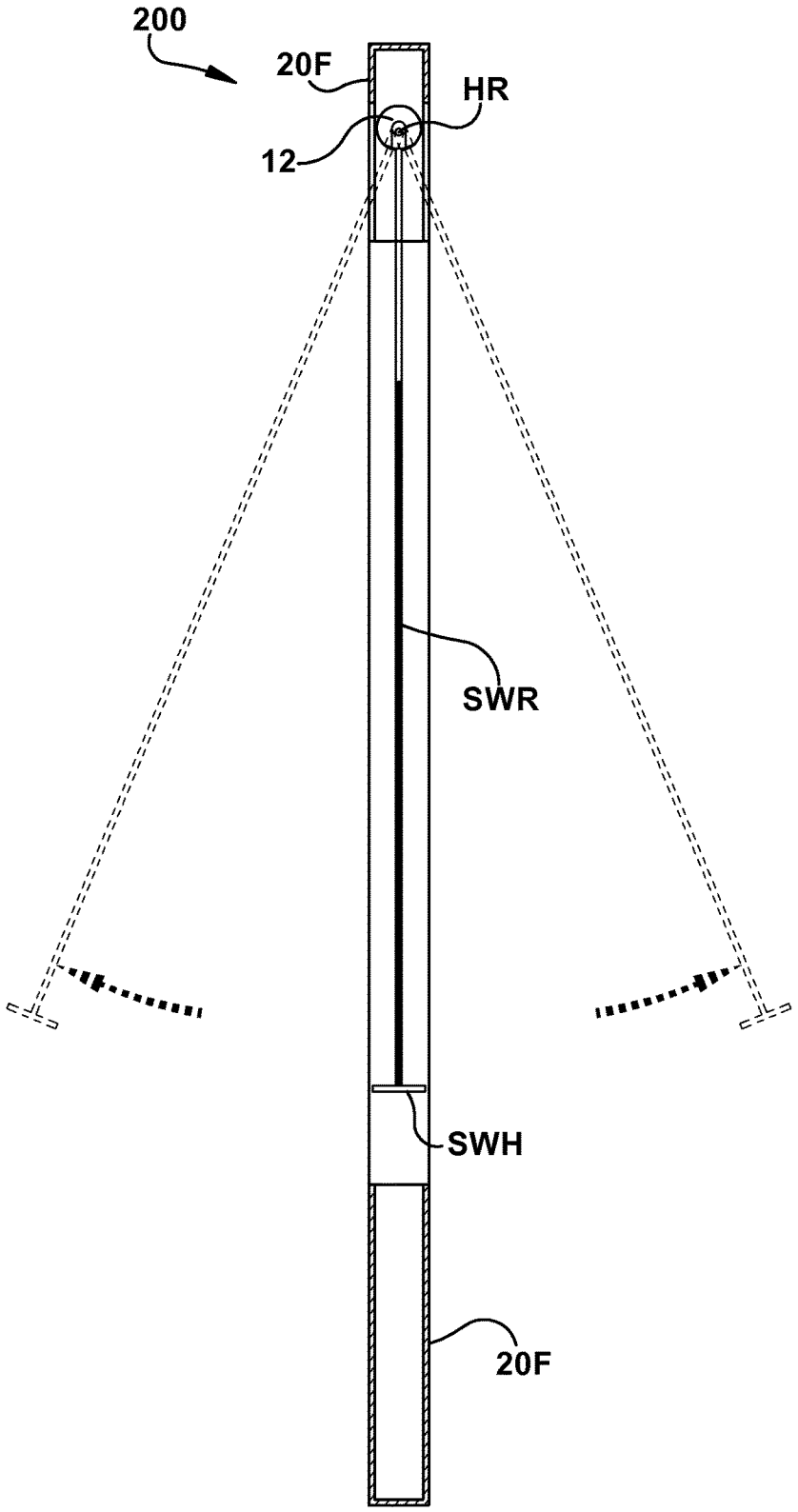
FIG. 11 is a cross-sectional view of the Greeting Card of FIG. 10.

In a preferred embodiment, the greeting card 200 contains a first panel 20A attached to a tab panel 20T along a first fold line F1, the tab panel 20T attached to a second panel 20B along a second fold line F2 and the second panel 20B attached to a third panel 20C along a third fold line F3. The second panel 20B contains a significant opening thereon. The second panel 20B is attached to the front surface of a foam structure 20F, the foam structure 20F having a front surface, rear surface and perimeter surface therebetween. The foam structure 20F may be, for example, approximately ¼-inch thick. The foam structure 20F also contains a large opening therein such that the foam is basically a frame having two vertical edges connected to two horizontal edges in a rectangular shape. The foam "frame" 20F contains various openings therein for the storage of electronic components of the greeting card 200 and for associated wiring connecting various components to a circuit board. A horizontal rod HR is contained horizontally in the upper horizontal portion of the foam frame 20F and is connected at one end to a small motor 12. Electronic components, such as those described above with respect to the first embodiment of the present invention, are contained in the lower horizontal portion of the foam "frame" 20F, but may be contained in any portion of the frame 20F or in another area of the greeting card. The second greeting card panel 20B is attached to a front surface of the foam structure 20F. A separate piece of planar sheet material may be attached to the rear surface of the foam structure, having an opening therein which matches that of the foam structure and second greeting card panel 20B. The vertical tab panel 20T is folded along the second fold line F2 to wrap around a side perimeter surface of the foam structure 20F wherein the first panel 20A is folded along the first fold line F1 to overlie the rear surface of the foam structure 20F or planar sheet material. The third panel 20C is then folded along the third fold line F3 to overlie the front surface of the foam structure 20F (covered by the second greeting card panel 20B). The first greeting card panel 20A serves as the front cover of the greeting card 200 and the third greeting card panel 20C serves as the back or rear cover of the greeting card 200. Since the card 200 is a traditional z-fold, the greeting card 200 is opened by pulling the front 20A and rear 20C greeting card covers in opposing outward directions, such as moving the front cover 20A to the left while moving the rear cover 20C to the right. Doing this reveals the front surface of all three greeting card panels 20A, 20B, 20C. The first 20A and third 20C panels may be slightly wider than the second greeting 20B card panel so that when the greeting card 200 is in the closed or folded position, the edge of the third greeting card panel (or rear cover of the greeting card) 20C can be seen (and gripped for opening the greeting card) from behind the first 20A and second 20B panels, as shown in FIG. 8. Each of the greeting card panels 20A, 20B, 20C may contain photos, artwork, text sentiment, or other printed indicia thereon.

A swing structure SW is attached or suspended from a horizontal rod HR located across the upper horizontal portion of the foam frame 20F such that the swing structure SW is contained in the open space between the foam "frame" 20F (and the opening in the second panel 20B). The swing structure SW contains two vertical portions SWR, SWL, each of which is attached at one end to the horizontal rod HR and at the opposite end to a horizontal seat portion SWH of the "swing" SW. A die cut shape DC representing a character is attached to the seat SWH and vertical portions SWR, SWL of the "swing" SW to appear as though the character DC is sitting on a swing. When activated, the motor 12 sends an electrical pulse through the horizontal rod HR (from which the swing SW is suspended) to effect the back-and-forth movement of the swing SW. The electrical pulse is sent in an on-off pattern wherein there is a pause between each pulse, allowing the swing-like movement. A slide switch 19 may be contained across one of the fold lines of the greeting card 200 such that when the greeting card 200 is opened, the motor 12 is activated and a sound module initiates replay of pre-recorded audio.

In operation, when the greeting card 200 is opened by the method described above, the front surface of all three greeting card panels 20A, 20B, 20C are revealed as well as the swing structure SW. Opening the greeting card 200 triggers both the sound and motor modules such that pre-recorded audio is replayed and the motor 12 causes the pulsed movement of the horizontal rod HR, which in turn causes the swing structure SW to move in a back-and-forth or swinging motion within the opening between the foam structure 20F and second greeting card panel 20B. Closing the greeting card 200 turns the motor and sound modules off. Alternately, the motor and audio may turn off after a pre-determined period of time.

In a variation of this embodiment, the motor module is removed, allowing the user to manually move the swing structure. Upon opening the greeting card, the swing structure is revealed and audio is replayed through the speaker. The user is then able to manually move the swing back-and-forth.

The second embodiment of the present invention has been described herein as having a z-fold configuration, however other greeting card folds and configurations have been contemplated and are considered to be within the scope of the present invention. While the switch used to initiate the sound and/or motor modules has been described herein and shown in the figures as being a slide switch, other switches may be used such as a push button switch, a slide lever switch, a contact switch, a magnetic switch, a light-sensitive switch, a touch-sensitive switch, or any other conceivable switch mechanism. Part of the greeting card has also been described as being made of foam, however other materials can be used instead and are considered to be within the scope of the invention.

Figure 12:
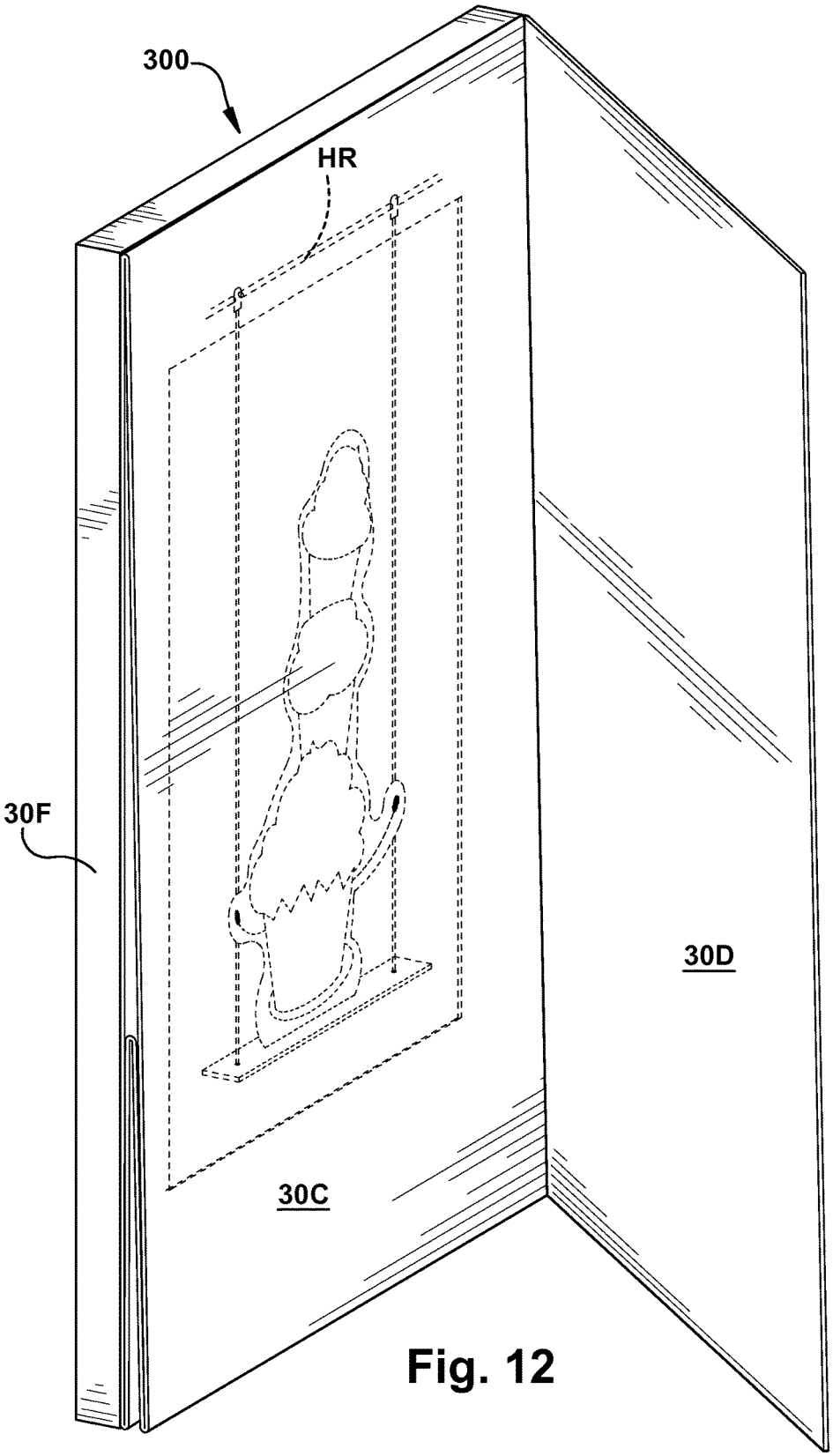
FIG. 12 is a rear perspective view of a third embodiment of the Greeting Card of the present invention, with open sentiment panel.
Figure 13:
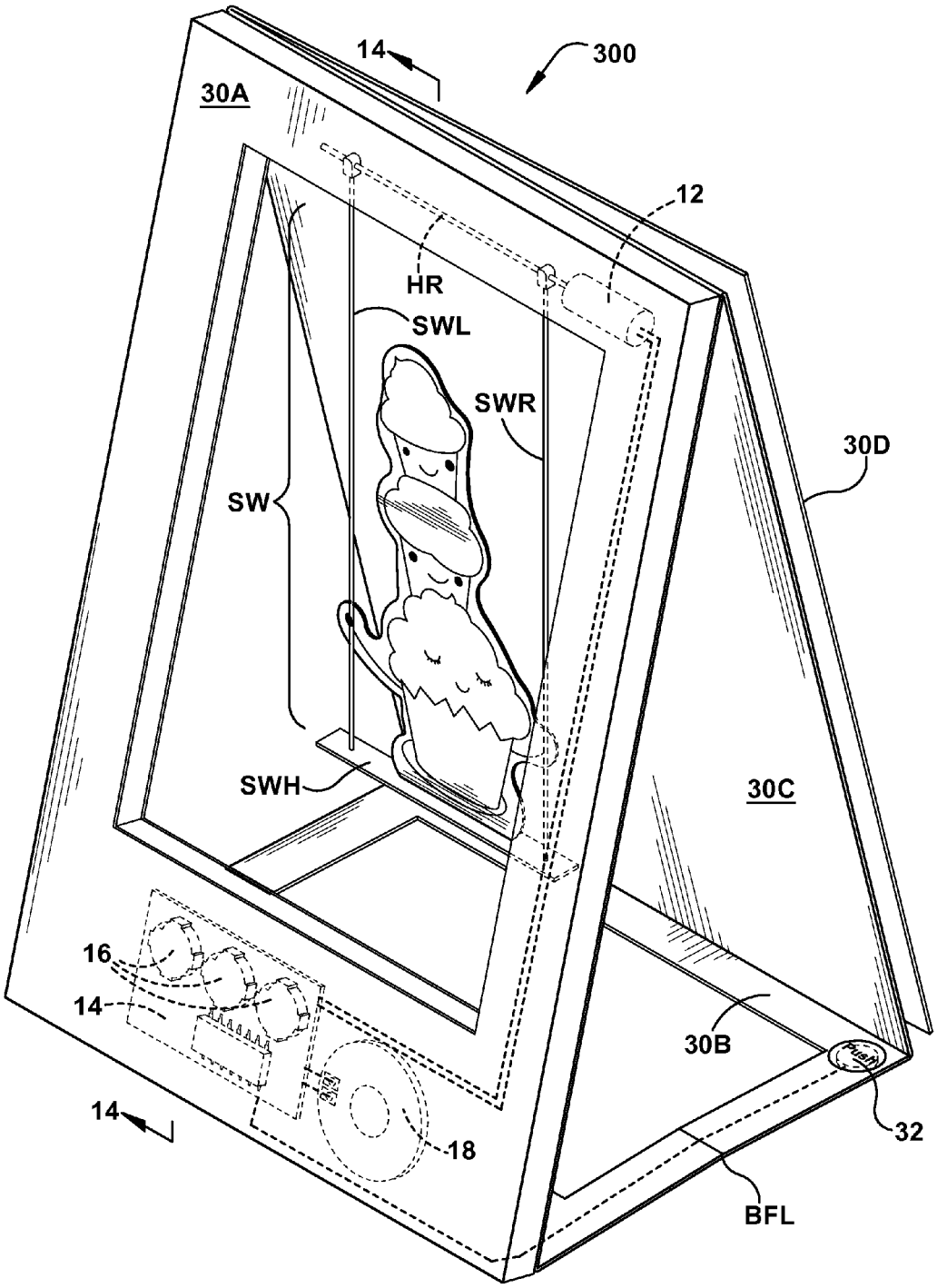
FIG. 13 is a perspective view of the Greeting Card of FIG. 12, in an open position, with closed sentiment panel.

In a third embodiment (similar to the second embodiment described directly above), the greeting card contains a swing mechanism that can have motorized or manual movement thereof. The greeting card 300 of this embodiment takes on a different shape from the z-fold as in the second embodiment described herein. This third embodiment, shown in FIGS. 12 through 15, includes a multi-panel greeting card body having a three greeting card panels 30A, 30B, 30C which are arranged, around a foam structure 30F, in a triangular configuration as shown in FIG. 13. Each panel contains a front surface opposite a rear surface. The rear surface of the first panel 30A is attached to a front face or surface of the foam structure 30F. The first panel 30A and the foam structure 30F each contain a substantial opening thereon, creating a frame structure with two vertical edges connected by two horizontal edges. The second greeting card 30B panel is attached to the bottom or lower edge of the first greeting card panel 30A. The second greeting card panel 30B also contains a substantial opening thereon and also contains a bisecting fold line BFL which allows the second panel 30B to fold upward, thereby opening and closing the triangular structure. The third greeting card panel 30C is attached at one horizontal edge to the second panel 30B and at the opposite horizontal edge to the top edge of the rear face or surface of the foam structure 30F. A fourth greeting card panel 30D (also referred to as a sentiment panel) is attached to the third panel 30C along left vertical side edge of the third greeting card panel 30C, as shown in FIG. 12. The fourth panel 30D pivots toward and away from the third greeting card panel 30C similar to a traditional greeting card. This fourth panel 30D may contain text sentiment, graphics, photos, pictures, or any other printed matter. It also provides a surface wherein a user can write a personal message and/or his/her signature. The foam structure 30F contains a substantially planar front surface, a substantially planar rear surface opposite the front surface and perimeter surface therebetween. The foam structure 30F may be, for example, approximately ¼-inch thick. The foam structure 30F also contains a large opening therein such that the foam is basically a frame having two vertical edges connected to two horizontal edges in a rectangular shape. The foam "frame" 30F contains various openings therein for the storage of electronic components of the greeting card 300 and for associated wiring connecting various components to a circuit board, as shown in FIG. 13. A horizontal rod HR is contained horizontally in the upper horizontal portion of the foam frame 30F and is connected at one end to a small motor 12, which may be contained in a cavity within the upper portion of the foam frame 30F. Other electronic components, such as those described above with respect to the first embodiment of the present invention (described above), are contained in the lower horizontal portion of the foam "frame" 30F, but may be contained in any portion of the frame 30F. The front surface of the first greeting card panel 30A (the rear surface being attached to the front face of the foam structure 30F), serves as the front page or face of the greeting card 300. The rear surface of the third panel 30C serves as the inside left panel of the greeting card 300. The front surface of the fourth panel 30D serves as the inside right panel of the greeting card 300 and the rear surface of the fourth panel 30D serves as the rear page or face of the greeting card 300.

A swing structure SW is attached or suspended from the horizontal rod HR located across the upper horizontal portion of the frame 30F such that it is contained in the open space between the foam "frame" 30F (and the opening in the second panel 30B), as shown in FIG. 13. The swing structure SW contains two vertical portions SWR, SWL, each of which is attached at one end to the horizontal rod HR and at the opposite end to a horizontal seat portion SWH of the "swing" SW. A die cut shape DC representing a character is attached to the seat SWH and vertical portions SWR, SWL of the "swing" SW to appear as though the character DC is sitting on a swing. When activated, the motor 12 sends an electrical pulse through the horizontal rod HR (from which the swing SW is suspended) to effect the back-and-forth movement of the swing SW. The electrical pulse is sent in an on-off pattern wherein there is a pause between each pulse, allowing the swing-like movement. A push button 32, in a preferred embodiment, is located within the second greeting card panel 30B, the push button 32 being connected via wiring to the circuit board 14 (preferably contained in a cavity in a lower portion of the foam structure 30F).

Figure 14:
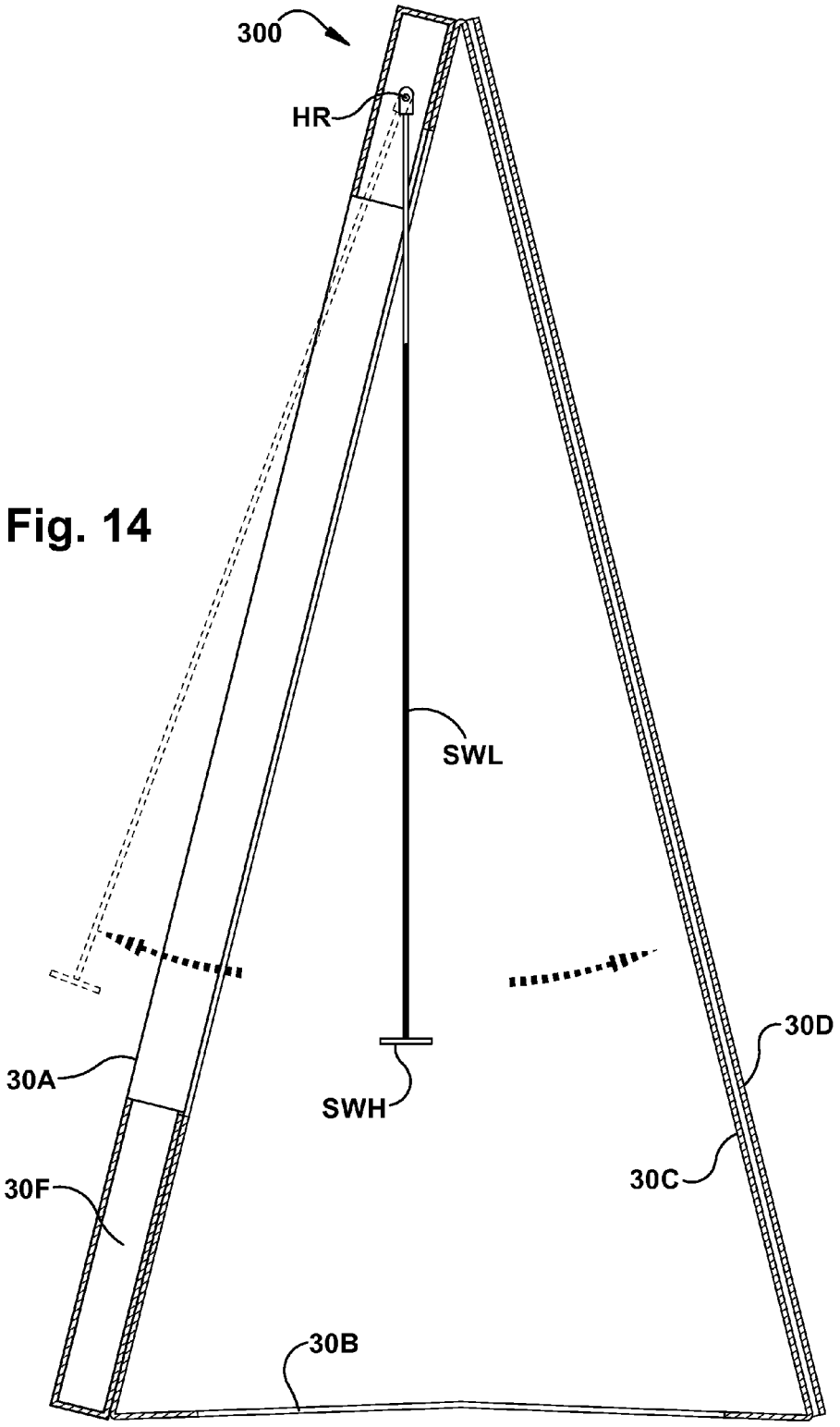
FIG. 14 is a side cross-sectional view of the Greeting Card of FIG. 13.
Figure 15:
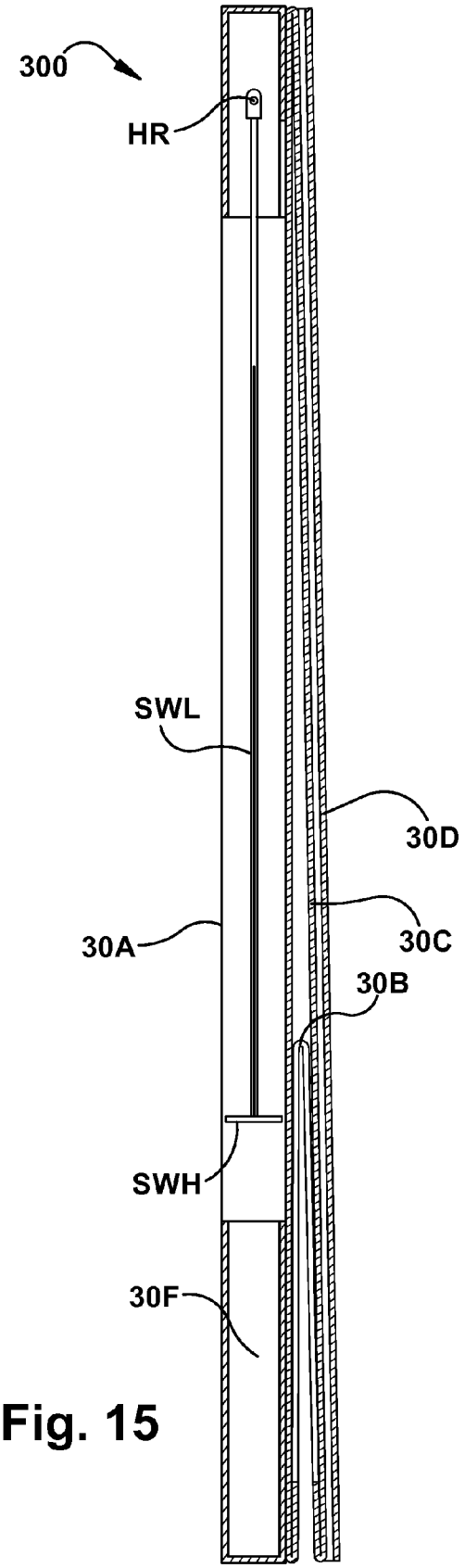
FIG. 15 is a side cross-sectional view of the Greeting Card of FIG. 13, in a closed position, with closed sentiment panel.

In operation, the greeting card is originally in a closed position, as shown in FIG. 15. The triangular structure is folded flat with the second panel 30B being folded upward along the bisecting fold line BFL so that the two halves of the second panel 30B are folded flat between the foam structure 30F and the third greeting card panel 30C. The fourth panel 30D is also closed flat (the front surface of the fourth panel 30D being in direct contact with the rear surface of the third panel 30C). The user may unfold the greeting card 300 by moving the first panel 30A (attached to the foam structure 30F) away from the third panel 30C thereby unfolding the second panel 30B and creating a triangular structure similar to an isosceles triangle. In this position, the swing structure SW dangles or hangs freely from the horizontal rod HR across the top of the triangular structure, as shown in FIG. 14. Pushing the push button 32 contained on the bottom of the triangular structure (second panel 30B) activates the motor module 12 thereby causing back-and-forth or swinging movement of the swing structure SW. It may also activates a sound module causing replay of one or more audio clips through the speaker 18. The audio may continue to play until for a pre-determined time or until the user presses the push button 32 a second time. The user may also move the fourth greeting card 30D panel away from the foam structure 30F to view the contents and possible personalized note and signature on the rear surface of the third panel 30C and/or the front surface of the fourth panel 30D.

Figure 16:
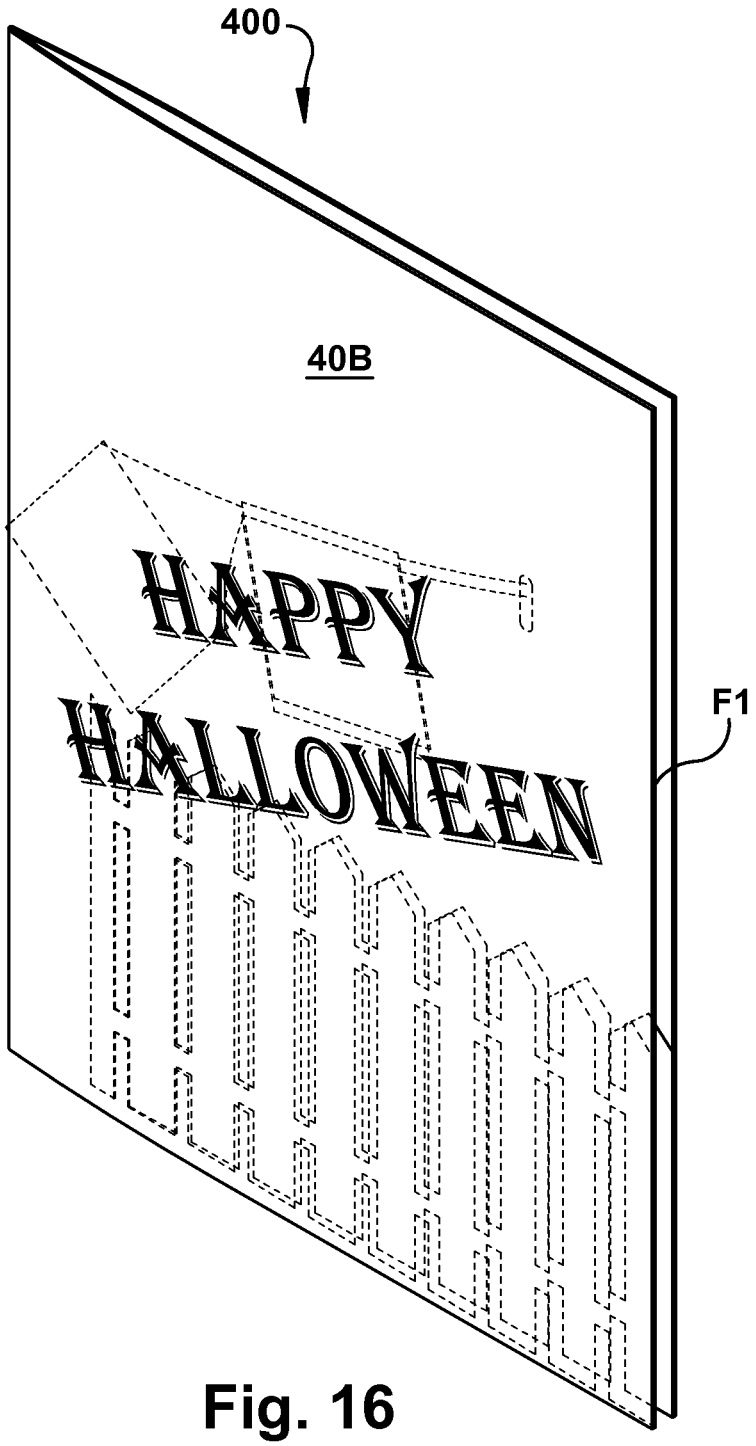
FIG. 16 is a perspective view of a third embodiment of the Greeting Card of the present invention, in a closed position.
Figure 17:
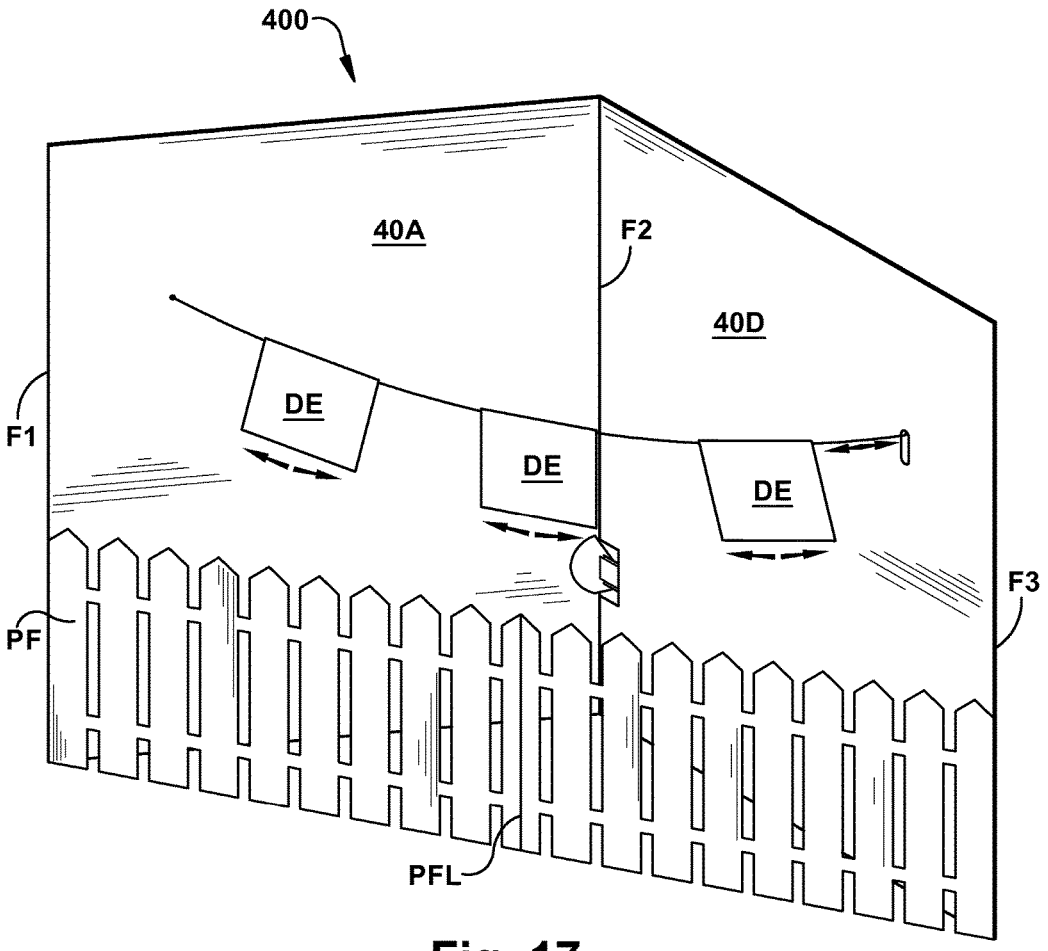
FIG. 17 is a perspective view of the inside of the Greeting Card of FIG. 16, in an open position.
Figure 18:
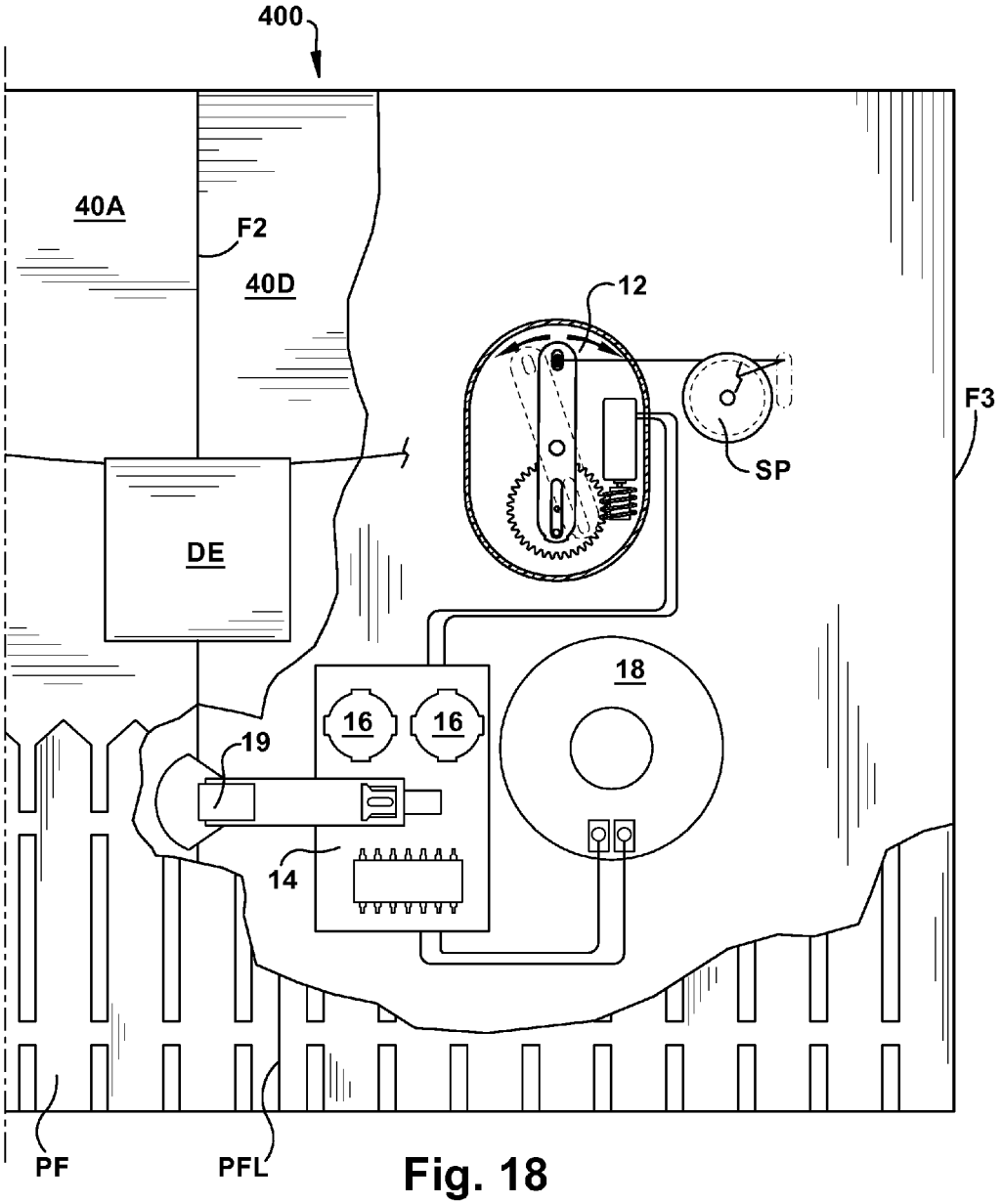
FIG. 18 is a front tear away view of the greeting card of FIG. 17.

In a fourth embodiment, the greeting card of the present invention includes a greeting card having four panels 40A, 40B, 40C, 40D which are folded to create two internal pockets or cavities and a two panel greeting card having a line or string S with one or more attachments DE attached thereto extended between the two panels, as shown in FIGS. 16 through 18. A first panel 40A is attached to a second panel 40B along a first fold line F1. The second panel 40B is attached to a third panel 40C along a second fold line F2. The third panel 40C is attached to a fourth panel 40D along a third fold line F3. The first panel 40A is folded over the first fold line F1 and attached along all free edges to the second panel 40B creating a first cavity or pocket therein. The fourth panel 40D is folded over the third fold line F3 and attached along all free edges to the third panel 40C creating a second cavity or pocket therein. The second panel 40B serves as the front cover of the greeting card 400. The first panel 40A serves as the inside left panel of the greeting card 400. The fourth panel 40D serves as the inside right panel of the greeting card 400 and the third panel 40C serves as the rear cover of the greeting card 400. The second fold line F2 serves as the main fold line bifurcating the greeting card 400. Folding the front cover 40B away from the rear cover 40C about the main fold line F2 opens the greeting card 400.

When the greeting card 400 is opened, an inner panel is revealed which resembles a picket fence PF attached to the outer edges of the right 40A and left 40D inside panels of the greeting card 400. The inner panel PF is shorter than the main greeting card panels 40A, 40B, 40C, 40D. It contains various cutouts thereon with a non-linear upper edges formed in a scalloped or zig-zag pattern so that the inner panel PF resembles a picket fence having various boards attached in a lateral or side-by-side manner. The inner fence-like panel PF contains a main fold line PFL which bifurcates the panel PF enabling it to be folded within the inner panels 40A, 40D of the greeting card 400 when the greeting card 400 is in the closed position. When the greeting card 400 is in a closed position, the inner panel PF is folded between the right 40D and left 40A side inner panels of the greeting card 400 such that the left side of the inner panel PF lies atop the right side of the inner panel PF. When the greeting card 400 is opened, the inner panel PF is unfolded and extends between the outer edges of the greeting card 400 creating a triangular configuration between the right 40D and left 40A inside panels and the inner fence-like panel PF, as shown in FIG. 17.

A string S is attached at one end to the left inside panel 40A of the greeting card 400 and at the opposite end to the right inside panel 40D of the greeting card 400. The string S is attached across an upper portion of the greeting card 400 above the inner fence-like panel PF. When the greeting card 400 is in a closed position the sting S contains slack and lies between the two inner panels 40A, 40D of the greeting card 400 and when the greeting card 400 is opened, the string S is pulled taut across the inner surface of the greeting card 400, as shown in FIG. 17. The string S contains one or more die cut shapes or decorative elements DE attached thereto or suspended therefrom. Die cut shapes or other elements DE may be sized and shaped to resemble articles of clothing suspended from a clothes line, as shown in the Figures.

Electronic components, including a small motor 12 are contained within the second pocket or cavity between the third 40C and fourth 40D greeting card panels. The motor 12 may be of the type having a rotating gear mechanism that when activated turns a circular gear. A connecting rod is located between and connects the gear to one end of the string S described above (through an opening in the inside left inside panel 40D of the greeting card 400). As the gear is rotated by the gear mechanism, it in turn causes the string S to move in a back-and-forth or up-and-down reciprocating motion. This motion causes the die cut shapes DE which are suspended from the string S to appear as though they are moving or blowing in the wind. As the right side end of the string enters through the right inside panel 40D of the greeting card 400 it is wound about a circular spool SP and then attached to the connecting rod of the motor 12. A sound module operative to store and replay at least one audio file and other electronic components which may be contained within the greeting card 400 include, but are not limited to:

a circuit board 14; an integrated circuit chip; a power source 16; a speaker 18; and a switch 19. The electronic components of the greeting card 400 described herein are considered to be readily understood and appreciated by one of ordinary skill in the art and are therefore not discussed in detail herein.

In operation, when the greeting card 400 is opened the inner fence-like panel PF is unfolded and the string S is pulled taut across the inside of the greeting card 400. A slide switch 19 located across the main fold line F2 initiates the sound and motor modules causes replay of audio through the speaker 18 and activation of the motor module 12 which causes the string S to move in a bouncing-like motion causing the die cut shapes or elements DE suspended therefrom to appear as though they are swaying in the wind.

While the fourth embodiment of the present invention has been described herein and shown in the figures as having a particular fold and number of panels, other greeting card folds, configurations and number of panels have been contemplated and are considered to be a part of the present invention.

While all of the greeting card embodiments described herein have been described and shown in the figures as having specific sizes, shapes, with particular electronic components and locations thereof, other options such as different sizes, shapes, types of motors, types of switches and such have been considered and are intended to fall within the scope of the present invention. The examples set forth and described herein are intended for illustrative purposes only and are not meant to limit the invention in any way.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A motion greeting card comprising:

a multi-panel greeting card body;

a foldable base structure attached to an inside surface of the multi-panel greeting card body;

a mobile structure attached to the foldable base structure comprising a circular disc having one or more attachments suspended therefrom;

a motor operative to cause movement of the circular disc when activated;

a switch which controls activation of the motor module;

wherein when the greeting card is in a closed position, the foldable base structure is folded into a position within and substantially parallel to two inside panels of the multi-panel greeting card body and when the greeting card is in an open position, the foldable base structure is unfolded into a position substantially perpendicular to the two inside panels of the greeting card; and wherein opening the greeting card closes the switch which activates the motor, thereby causing the mobile structure to move in a circular motion.

2. The motion greeting card of claim 1, further comprising a sound module operative to store and replay at least one audio file through a speaker.

3. The motion greeting card of claim 2, wherein opening the greeting card also causes playback of the at least one audio file stored on the sound module.

4. The motion greeting card of claim 1, wherein the switch is a slide switch.

5. The motion greeting card of claim 1, wherein the motor is located within a cavity in the foldable base structure.

6. A greeting card comprising:

a greeting card body;

a foldable structure contained between two panels of the greeting card body, the foldable structure operative to move between a first position wherein it is folded between the two panels of the greeting card body and a second position wherein it is unfolded between the two panels of the greeting card body;

a base panel which is attached to the foldable structure, the base panel having at least one attachment suspended therefrom;

a motor contained within the foldable structure, the motor module operative to cause movement of the base panel and the at least one attachment suspended from the base panel upon activation thereof.

7. The greeting card of claim 6 further comprising a switch which controls activation of the motor.

8. The greeting card of claim 7, wherein opening the greeting card closes the switch causing activation of the motor and movement of the base panel and at least one attachment.

9. The greeting card of claim 6 further comprising a sound module operative to store and playback at least one audio file stored thereon through a speaker.

10. The greeting card of claim 6 further comprising a switch operative to control activation of the sound module.

11. The greeting card of claim 10, wherein the switch is a slide switch.

12. A greeting card comprising:

a greeting card body comprising a plurality of panels;

a foldable structure contained within the greeting card body wherein when the greeting card is in a closed position, the foldable structure is folded into a substantially flat position and when the greeting card is in an open position, the foldable structure is unfolded into a position perpendicular to the greeting card body;

a mobile object attached to the foldable structure;

a motor module attached to the mobile object;

a switch which controls activation of the motor module;

wherein closing the switch activates the motor module thereby causing movement of the mobile object.

13. The greeting card of claim 12 further comprising one or more attachments suspended from the mobile object.

14. The greeting card of claim 13, wherein the one or more attachments are suspended from the mobile object via a string.

15. The greeting card of claim 12 further comprising a sound module having at least one audio file saved thereon.

16. The greeting card of claim 12, wherein the switch also controls activation of the sound module thereby causing playback of the at least one audio file through a speaker.

* * * * *